United States Patent [19]

Mattix

[11] 4,402,424

[45] Sep. 6, 1983

[54] LABEL DISPENSING MACHINE

[75] Inventor: Harold R. Mattix, Lisbon, Ohio

[73] Assignee: Ohio Electronics Machinery, Inc., Sebring, Ohio

[21] Appl. No.: 327,574

[22] Filed: Dec. 4, 1981

[51] Int. Cl.[3] ..... B65C 9/42

[52] U.S. Cl. ..... 221/13; 221/22; 221/73; 156/584

[58] Field of Search ..... 221/2, 9, 10, 13, 15, 221/22, 23, 69–73; 156/584, DIG. 33

[56] References Cited

U.S. PATENT DOCUMENTS

| | | | |
|---|---|---|---|
| 1,637,710 | 8/1927 | Rider | 221/22 |
| 2,522,224 | 9/1950 | Hedinger, Jr. | 101/288 |
| 2,802,598 | 8/1957 | Petterson | 221/22 X |
| 2,920,780 | 1/1960 | Hauschild et al. | 216/9 |
| 3,029,979 | 4/1962 | Freeland | 221/22 |
| 3,033,417 | 5/1962 | Van Meer | 221/13 |
| 3,193,430 | 7/1965 | Messmer et al. | 156/355 |
| 4,019,935 | 4/1977 | Harvey | 156/64 |
| 4,048,494 | 9/1977 | Liesting | 221/73 X |
| 4,188,252 | 2/1980 | Brown | 156/361 |
| 4,239,570 | 12/1980 | Kerwin | 156/163 |
| 4,267,004 | 5/1981 | Anderson | 156/584 X |
| 4,288,272 | 9/1981 | Pfeffer | 221/73 X |
| 4,303,461 | 12/1981 | La Mers | 156/584 X |
| 4,347,950 | 9/1982 | Onishi | 221/15 X |

OTHER PUBLICATIONS

Columbia Research and Manufacturing Co., Inc. Bulletin RSE.

*Primary Examiner*—Joseph J. Rolla

*Attorney, Agent, or Firm*—Oldham, Oldham, Hudak, Weber & Sand Co.

[57] ABSTRACT

A machine for individually dispensing die cut pressure-sensitive labels from the carrier web of a label train. An AC synchronous stepping motor rotates a pair of drive rolls for a predetermined time period sufficient to move the label train from a supply roll past an infrared detecting member to a discharge end of the machine. The web moves downwardly over the discharge end of the machine and partially discharges an individual label. A microswitch is actuated upon complete dispensing of a label, which sends a pulse through appropriate control circuitry to reactuate the stepping drive motor which advances the label train to partially dispense the next label. The infrared detecting member senses the density difference of the label gap between adjacent labels on the moving web and sends a stop signal to a timer of the control circuitry which will deactivate the motor at the end of the predetermined preset time period. A potentiometer in the control circuitry enables the label feed time to be adjusted by modifying a time delay signal in the motor stop circuitry. The gap sensing prevents accumulated error in the stop position of the partially dispensed labels due to misplacement of labels on the carrier web, and the potentiometer enables the machine to be readily adjusted to accommodate labels of various lengths.

11 Claims, 13 Drawing Figures

LABEL DISPENSING MACHINE

BACKGROUND OF THE INVENTION

1. Field of the Invention

The invention relates to apparatus for individually dispensing die cut pressure-sensitive labels from a carrier web containing a plurality of such labels. More particularly, the invention relates to a label dispensing machine having detecting means which senses the gap between adjacent labels on the carrier to stop the web at the proper label discharged position, and to a machine which can be adjusted easily to accommodate labels of different lengths.

2. Description of the Prior Art

Various types of label dispensing machines are known in the prior art for dispensing labels from a label train either automatically onto a moving article or manually for placement on an article. Many of these prior machines use various interconnected mechanical components to properly position the label at its discharged position. Other machines use a timing circuit which automatically advances the moving web for a predetermined time period upon the label being dispensed in an attempt to place the adjacent label at the correct label dispensing position. However, problems occur in that the labels are sometimes irregularly spaced on the web and/or a label is missing, which provides a faulty signal to the timing and feed control mechanism. Also, small differences in spacing between the individual labels will accumulate over a period of time, affecting the discharge position of the dispensed label.

Examples of prior label dispensing machines which use electromechanical control means and positioning switches for regulating the movement of the label being dispensed or article having a label applied thereto are shown in U.S. Pat. Nos. 3,029,979, 3,039,516, and 3,169,895.

Various other label dispensing machines and label applying mechanisms control the dispensing operation and/or movement of articles being labeled by the use of various photoelectric sensing means which control either the drive mechanism of the label dispenser and/or the movement of the article. Examples of such constructions are shown in U.S. Pat. Nos. 2,522,224, 2,920,780, 3,193,430, 4,019,935, 4,188,252, U.S. Pat. No. Re. 30,419, U.S. Pat. Nos. 4,239,570 and 4,248,655.

However, none of these prior art machines show a label dispensing machine relatively simple in operation and construction which uses an infrared photoelectric sensing mechanism which senses the density difference between the label and gaps between adjacent labels for controlling a stepping motor having an adjustable actuation time period for advancing the label to the discharge position, and in which control means enable the machine to be used for labels of different lengths.

SUMMARY OF THE INVENTION

Objectives of the invention include providing a simple, compact and relatively inexpensive label dispensing machine for individually dispensing die cut pressure-sensitive labels, a plurality of which are mounted in spaced relationship on a web of a label train, in which an ac synchronous stepping motor automatically advances the web to the label discharge position at which a considerable portion of the label is automatically separated from the web for manual grasping by an individual for application to an article being labeled, and in which removal of the label from the web will actuate a switch which automatically energizes appropriate control circuitry for advancing the adjacent label to the partially dispensed position. Another objective is to provide such a dispensing machine in which the stepping motor has a breakdown torque low enough so that if an object gets caught between the drive and driven rolls thereof the motor will go into a stall condition causing no adverse effects on the driving mechanism and machine components. Another objective is to provide such a machine in which infrared photoelectric detecting means senses the gaps between labels due to the difference in densities between the label gap and labels so that misplacement of labels on the carrier web causes no accumulated error in the label dispense stop position by automatically compensating for such misalignment.

A still further objective is to provide such a label dispensing machine in which the stepping motor is only actuated during label advancement and is not continuously energized as in other label dispensing machines. Another objective is to provide such a dispensing machine in which the control circuitry can be solid state electronic components less susceptible to maintenance and repair than in prior dispensing machines using mechanical control systems, and in which the label feed time is readily adjustable by changing a potentiometer setting or similar component which modifies the time delay of the stop mode of the machine, whereby the machine can be adapted to accommodate labels of various lengths conveniently and economically, and in which the detection and control features thereof can be incorporated into various types of label dispensing machines. Another objective is to provide such a label dispensing machine which eliminates difficulties heretofore encountered, achieves the stated objectives simply and effectively, and solves problems and satisfies existing needs.

These objectives and advantages are obtained by the label dispensing machine, the general nature of which may be stated as including a slide plate; means for supporting a supply of labels and their carrier web; feed means for moving the web and labels across the slide plate; switch means for actuating the feed means upon removal of a label from the carrier web; electronic sensing means mounted adjacent the slide plate in the path of the moving web and labels for detecting the spacing between adjacent labels, said sensing means producing a signal upon detection of said label spacing; electronic timer means actuated by the signal from the sensing means for deactuating the feed means after passage of predetermined preset feed means actuated time period; and adjustment means for regulating the preset feed means actuated time period of the timer means.

BRIEF DESCRIPTION OF THE DRAWINGS

A preferred embodiment of the invention, illustrative of the best mode in which applicant has contemplated applying the principles, is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 1:
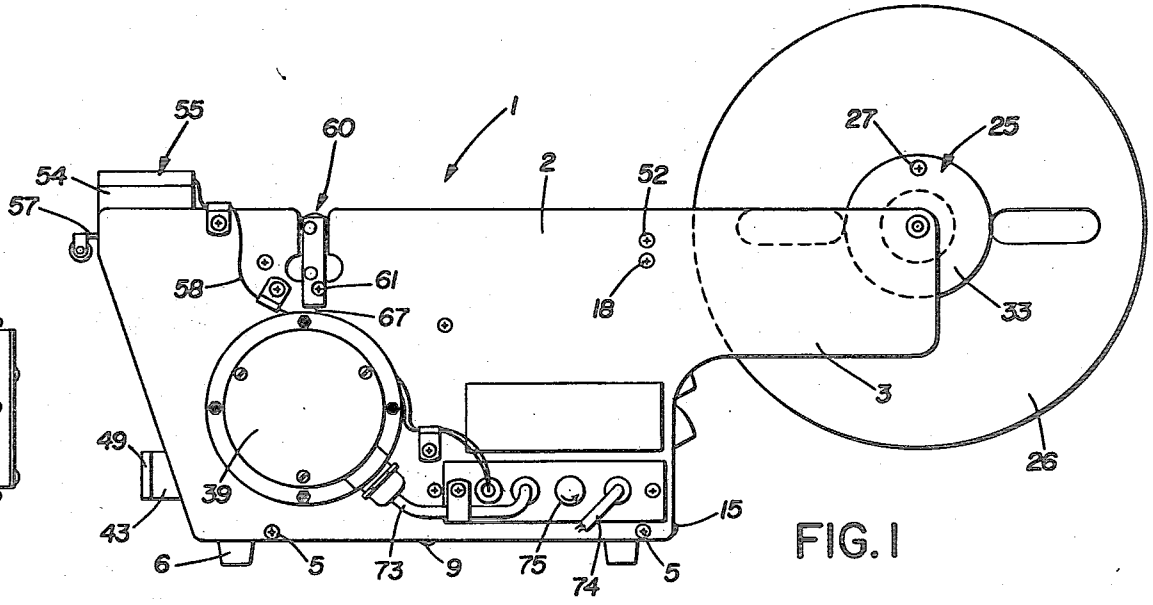
FIG. 1 is a side elevational view of the improved label dispensing machine construction.

The improved label dispensing machine is indicated generally at 1 and is shown particularly in FIGS. 1–5. Machine 1 includes a main side plate 2, shown particularly in FIG. 1, which is an elongated, generally flat metal member preferably formed of aluminum. Side plate 2 has an elongated reel-mounting arm 3 projecting rearwardly from the main body portion thereof. Side plate 2 is mounted on and extends vertically upwardly from a rectangular-shaped base plate 4 and is mounted thereon by screws 5. A plurality of rubber-covered feet 6 are mounted on the four corners of base plate 4 for supporting machine 1 on a table or other object.

Figure 4:
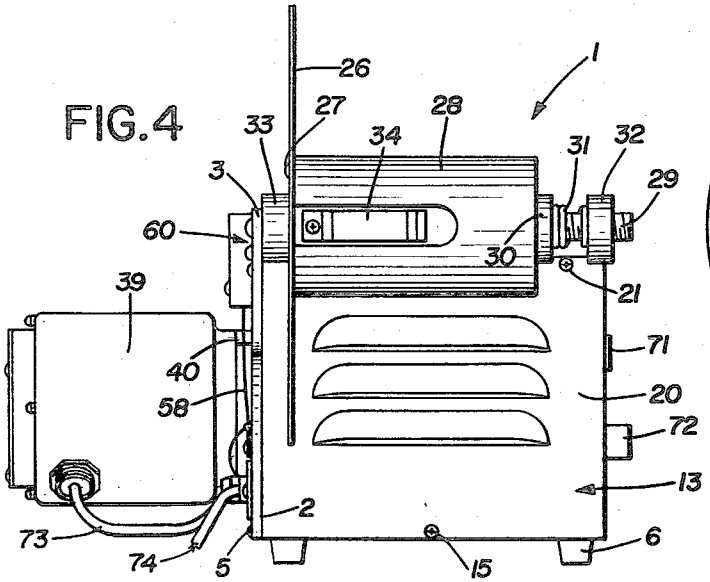
FIG. 4 is a left-hand view of the machine as shown in FIG. 2 showing the label feed supply end thereof.

A vertically extending center plate 8 is mounted on base 4 and side frame 2 by screws 9 and 10, respectively. Center plate 8 preferably is mounted generally at the midpoint of base plate 4 and divides the base into front and rear sections. An L-shaped housing cover 12 together with a portion of side plate 2 and the rear section of base 4 forms a housing 13 at the rear portion of machine 1. Cover 12 is secured to center plate 8 by screws 14 (FIG. 2) and to base 4 by screws 15 (FIG. 4). Housing cover 12 forms housing 13 in which are located the electrical circuitry and majority of the machine control components.

A top slide plate, indicated generally at 17, is mounted on side wall 2 by screws 18 (FIG. 1) and on center plate 8 by mounting screws 19 (FIG. 5) and to the rear panel 20 of housing cover 12 by screws 21 (FIG. 4). Slide plate 17 as a rectangular configuration and terminates in a tapered label discharge front edge 22 which preferably has a friction-reducing plastic coating 23.

A label supply roll assembly, indicated generally at 25, is mounted on the upper rear corner of reel-supporting arm 3 of side frame 2. Supply roll 25 includes a backing disc 26 which is attached by screw 27 (FIG. 1) to a supply reel 28 (FIG. 4) which is mounted on a supply roll shaft 29. A usual clutch mechanism consisting of an outer clutch hub 30, a clutch spring 31 and a spring retainer 32 mounted on the outer threaded end of shaft 29 cooperate with an inner clutch hub 33 to enable a predetermined adjustable discharge tension to be placed on roll assembly 25. A spring clip 34 is mounted on supply reel 28 for maintaining a roll of labels to be dispensed on the supply reel by exerting a radially outwardly biasing force against the inner core of the supply roll of labels.

Figure 8:
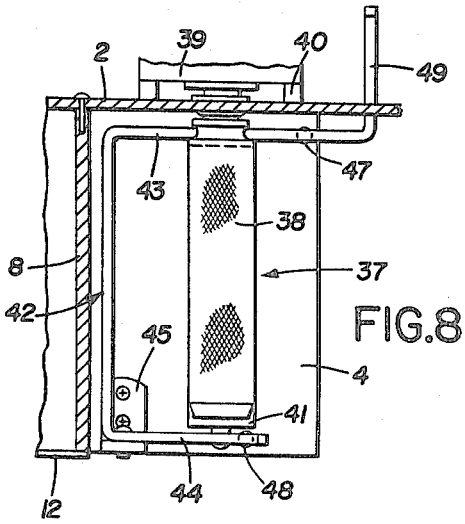
FIG. 8 is a fragmentary sectional view taken on line 8—8, FIG. 2.
Figure 9:
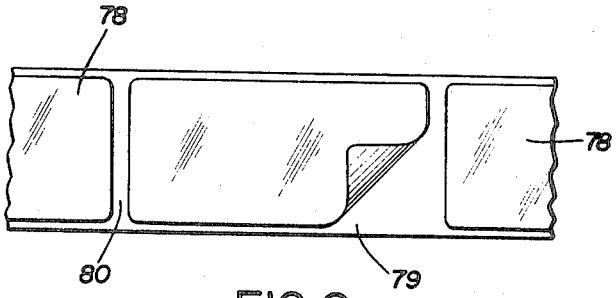
FIG. 9 is a fragmentary view of a carrier web containing a plurality of pressure-sensitive labels removably mounted thereon.

A label web take-up assembly, indicated generally at 37 (FIGS. 2, 3 and 8), is located beneath the front portion of top slide plate 17 forwardly of center plate 8. Take-up assembly 37 includes a drive roll 38 preferably having a knurled outer surface enabling it to securely grip and drive the web after the individual labels have been removed therefrom. Drive roll 38 is rotatably mounted in side frame 2 and is operatively connected to and driven by a motor 39 which is mounted on the outside surface of side frame 2 by a plurality of mounting posts 40.

A driven roll 41 is freely rotatably mounted beneath drive roll 38 on a loading handle, indicated generally at 42. Loading handle 42 has a generally U-shaped configuration with a pair of side legs 43 and 44 on which driven roll 41 is rotatably mounted. Handle 42 is pivotally mounted on an L-shaped bracket 45. A pair of springs 47 and 48 are operatively engaged with the forward ends of loading handle legs 43 and 44, respectively, biasing driven roll 41 upwardly into engagement with drive roll 38. Driven roll 41 preferably is covered with a resilient material such as urethane, which enables the knurled surface of drive roll 38 to press the web against drive roll 41 to ensure a firm driving engagement for moving the web between the rotating rolls when drive roll 38 is rotated by motor 39.

An outwardly extending end 49 (FIGS. 3 and 8) of loading handle 42 provides a convenient projection enabling an operator to depress springs 47 and 48 by the downward pivotal movement of loading handle 42 whereby the free end of a web can be placed between the rolls when a supply of labels is loaded on the machine. A cylindrical guide shaft or bar 51 is mounted on the upper end of side frame 2 by a screw 52 and extends transversely across the rear portion of slide plate 17 and across the movement path of the labels and web. Shaft 51 guides the label carrier web from a supply roll thereof along the slide plate.

Figure 5:
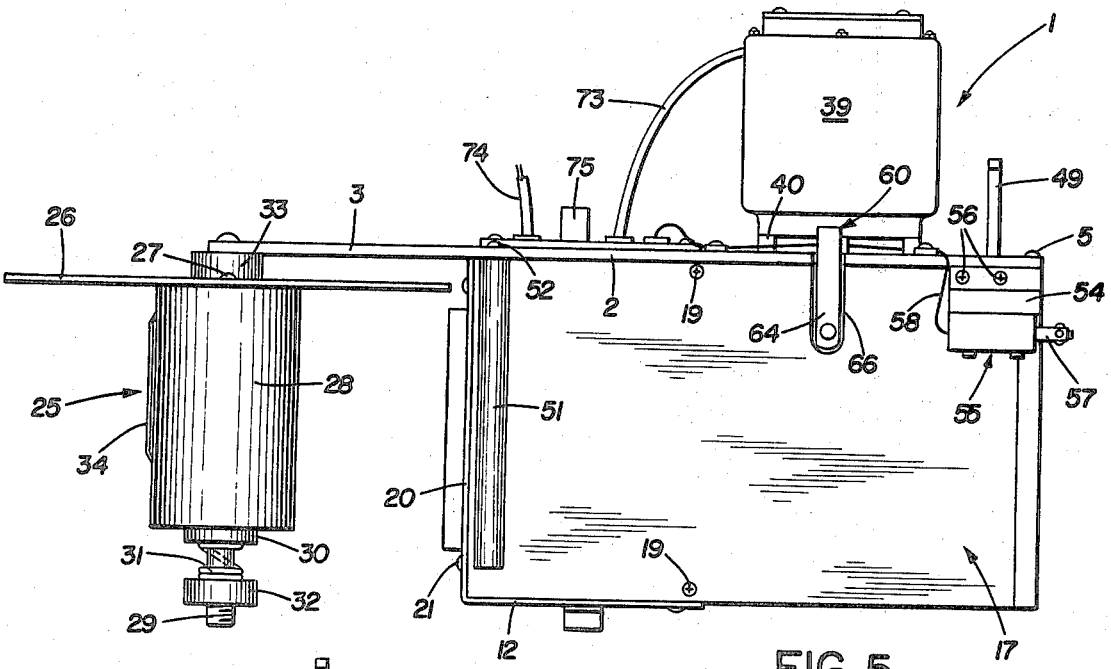
FIG. 5 is a top plan view of the label dispensing machine shown in FIGS. 1–4.

A microswitch, indiated generally at 55, is mounted on the outer label discharge edge of slide plate 17 adjacent the outer upper corner of side frame 2 by a mounting block 54 and a pair of bolts 56 (FIG. 5). Microswitch 55 includes a trip arm 57 which projects outwardly beyond the discharge edge 23 of slide plate 17, as shown in FIGS. 2 and 5. Switch 55 is connected to the control circuitry located within housing 13 by a wire 58 which extends along the outer surface of side frame 2, as shown in FIG. 1.

Figure 6:
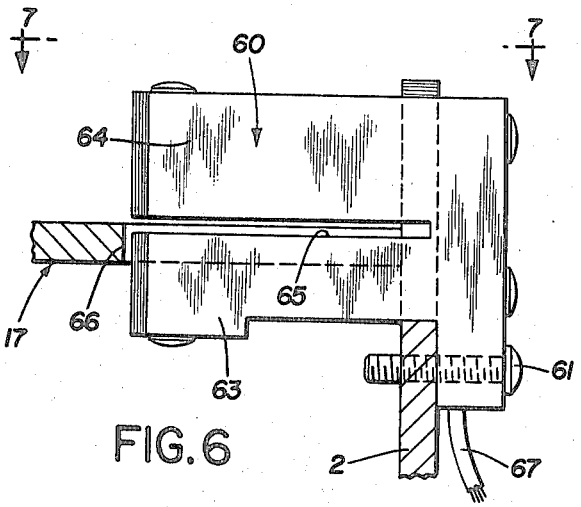
FIG. 6 is an enlarged fragmentary sectional view taken on line 6—6, FIG. 2, of the infrared label gap sensing assembly.
Figure 7:
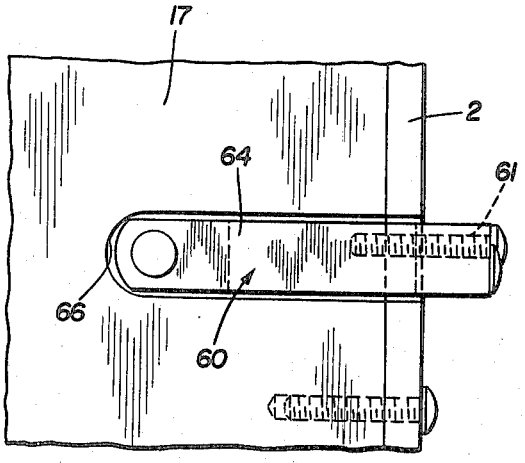
FIG. 7 is a fragmentary top plan view of the infrared label gap sensing assembly looking in the direction of arrows 7—7, FIG. 6.

In accordance with one of the features of the invention, an infrared photocell assembly, indicated generally at 60, is mounted on side plate 2 by a bolt 61. Photocell assembly 60 is formed of cast aluminum and has a somewhat rectangular shape having a lower infrared emitter section 63 and an upper infrared sensor or receiver section 64 separated by an elongated gap 65 (FIG. 6). Photocell 60 extends transversely into the slide path of the label and carrier web, and is located within a transversely extending slot 66 formed in an edge portion of slide plate 17 adjacent side plate 2 (FIGS. 5-7). The control wires for the emitter and receiver extend through holes formed in sections 63 and 64 and are connected to the control circuitry of the rest of the system by a wire 67. Assembly 60 preferaly has a black or dark coating applied thereto to reduce the possibility of glare or other incidental light from affecting the operation of the photocell.

A main power ON-OFF button 71 extends through an opening formed in panel section 70 of L-shaped housing cover 12 (FIG. 2), and a label length adjustment knob 72 extends outwardly through another opening formed in panel section 70 beneath power button 71. A LED 68 is visible through an opening formed in center plate 8 (FIG. 3) and provides a visual signal as to the sensitivity of photocell 60 which is adjustable through another opening 69 formed in plate 8 adjacent LED 68. This enables photocell 60 to be adjusted for efficient operation with label carrier webs of different densities. The purposes of these components are described in greater detail below.

Figure 2:
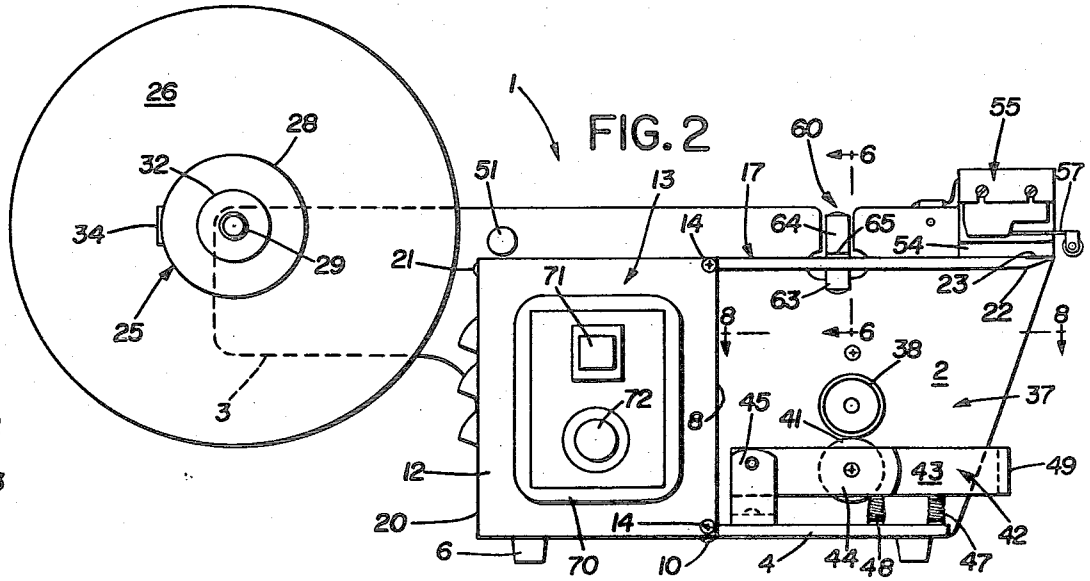
FIG. 2 is an opposite side elevational view from the view of FIG. 1 of the improved label dispensing machine.
Figure 3:
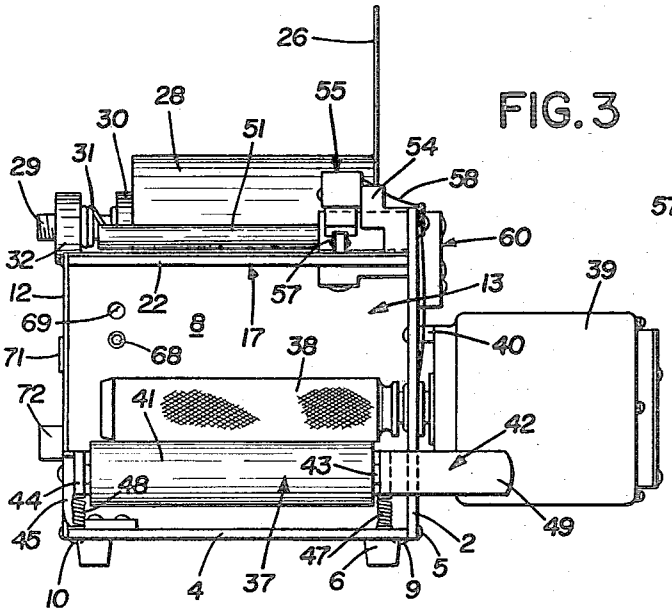
FIG. 3 is a left-hand view of the label dispensing machine as shown in FIG. 1 showing the label discharge end thereof.

In accordance with another feature of the invention, motor 39 is an ac synchronous stepping motor and is connected to the control circuitry contained within housing 13 by a power line 73 (FIG. 1). Another power line 74 extends outwardly from within housing 13 through side plate 2 for connection to a 120-volt ac power supply. A replaceable fuse is mounted within a fuse holder 75 which extends outwardly from side plate 2 adjacent power lines 73 and 74. Motor 39 may be of the type manufactured and sold by The Superior Electric Company of Bristol, Connecticut, under its trademark SLO-SYN as Model No. SS150-1077U. This type of motor has the advantage of a low breakdown torque so that if an object gets caught between the drive and driven rolls, the motor will go into a "stall" condition causing no damage to the drive mechanism. Furthermore, such a motor provides for extremely accurate and controlled rotation without any appreciable coasting so that accurate control can be obtained for movement of the label carrier web.

Figure 10:
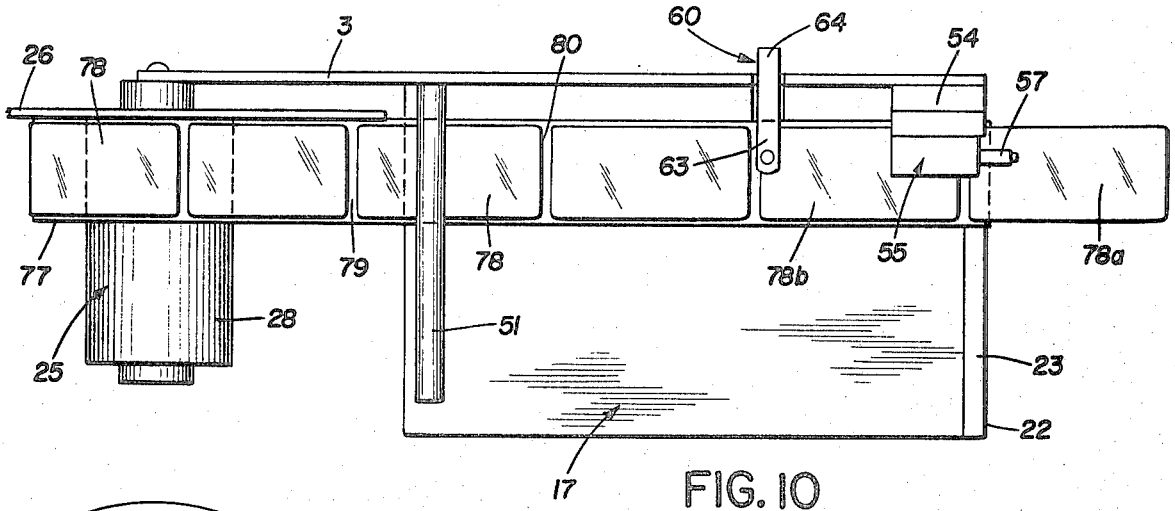
FIG. 10 is a diagrammatic top plan view similar to FIG. 5 showing a label being dispensed from the machine.
Figure 11:
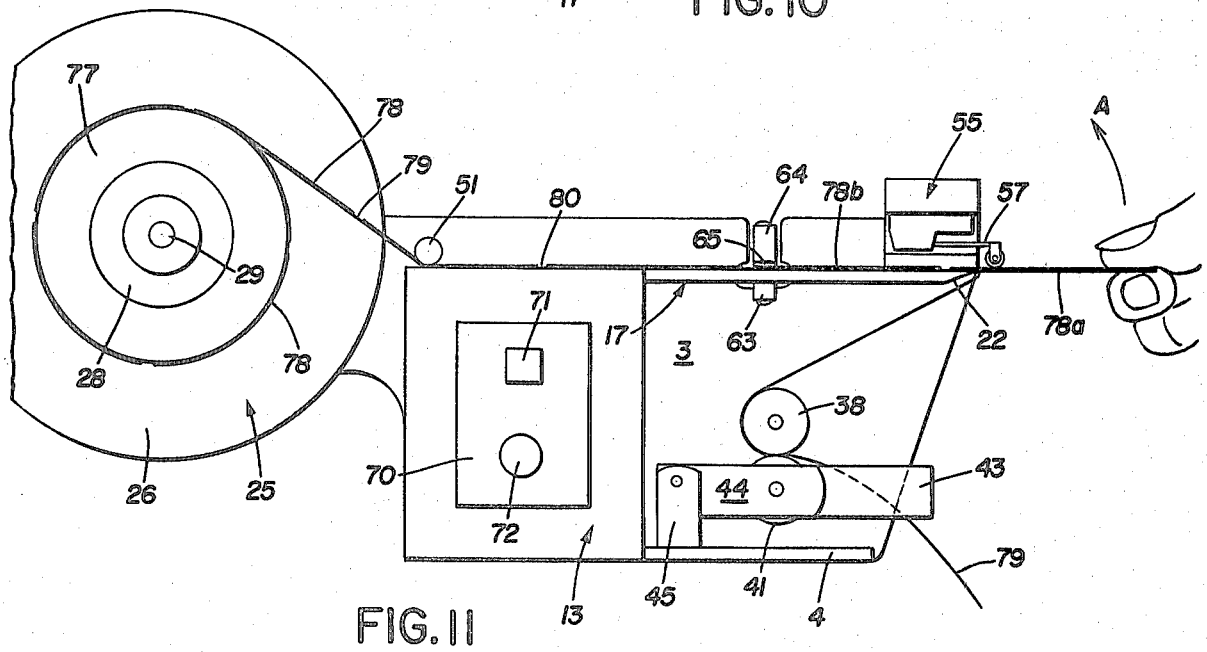
FIG. 11 is a fragmentary diagrammatic view similar to FIG. 2 showing the label of FIG. 10 being dispensed.
Figure 12:
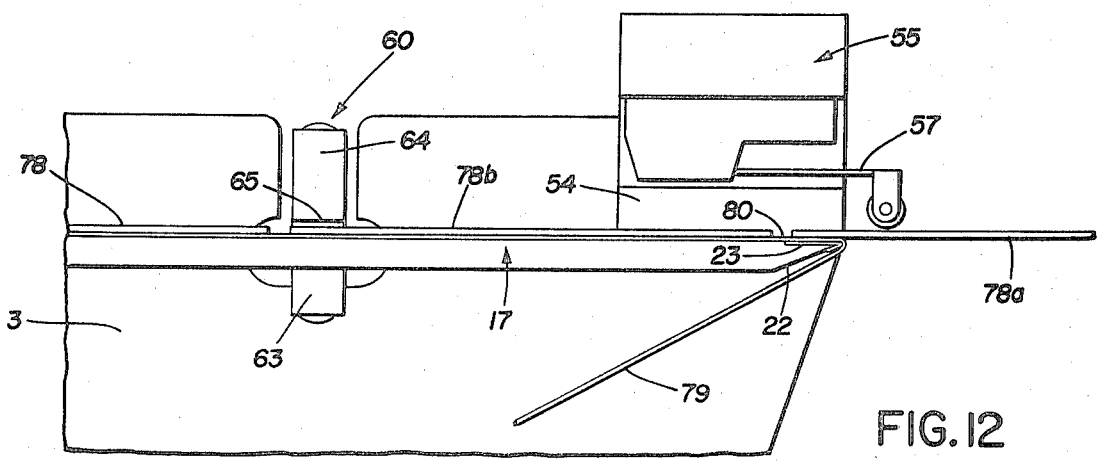
FIG. 12 is a greatly enlarged fragmentary view of the upper right-hand portion of FIG. 11.

The general operation of improved label dispensing machine 1 is as follows. A roll 77 containing a plurality of die cut pressure-sensitive labels 78 which are mounted in spaced relationship on an elongated carrier web 79, is mounted on supply reel 28 of supply roll assembly 25. The carrier web is placed under guide shaft 51 and extends along slide plate 17 and passes through gap 65 of photocell 60 and extends about discharge edge 22 of plate 17 and passes downwardly between rolls 38 and 41 (FIGS. 10, 11 and 12).

Main power switch 71 is pressed to the ON position. A label 78*a* extends partially outwardly beyond edge 22 of slide plate 17 and has only a small portion thereof adhered to web 79 by the pressure-sensitive adhesive on the back side thereof. Label 78*a* is removed manually in an upward motion, as shown in FIG. 11 by arrow A, which will move switch arm 57 upwardly to actuate switch 55. Actuation of switch 55 will send a pulse to the logic start circuit which, in turn, activates stepping drive motor 39. Actuation of drive motor 39 will rotate drive roll 38, advancing the carrier web and labels along slide plate 17.

The infrared detector of photocell 60 will sense the density difference of label gap 80 as the labels advance through photocell sensing gap 65. A stop signal is fed into and actuates a precision solid state timing circuit which has been preset for a predetermined time period. A signal is generated at the end of the time cycle which deactuates motor 39 and stops the advance of the web and labels. This motor-actuated time period is preset whereby the adjacent label 78*b* will assume the partially dispensed position at the forward end of slide plate edge 22 similar to that shown in FIGS. 11 and 12 for label 78*a*. Manual removal of label 78*b* then will restart the dispense cycle described above.

The machine will sit idle until this next partially dispensed label is removed. In accordance with another of the features of the invention, motor 39 is in an electrically OFF position and will consume no power until re-energized to advance the next label to the partially dispensed position. The details of the control system and the electronic circuitry and components thereof are shown in FIG. 13 and are described below.

Figure 13:
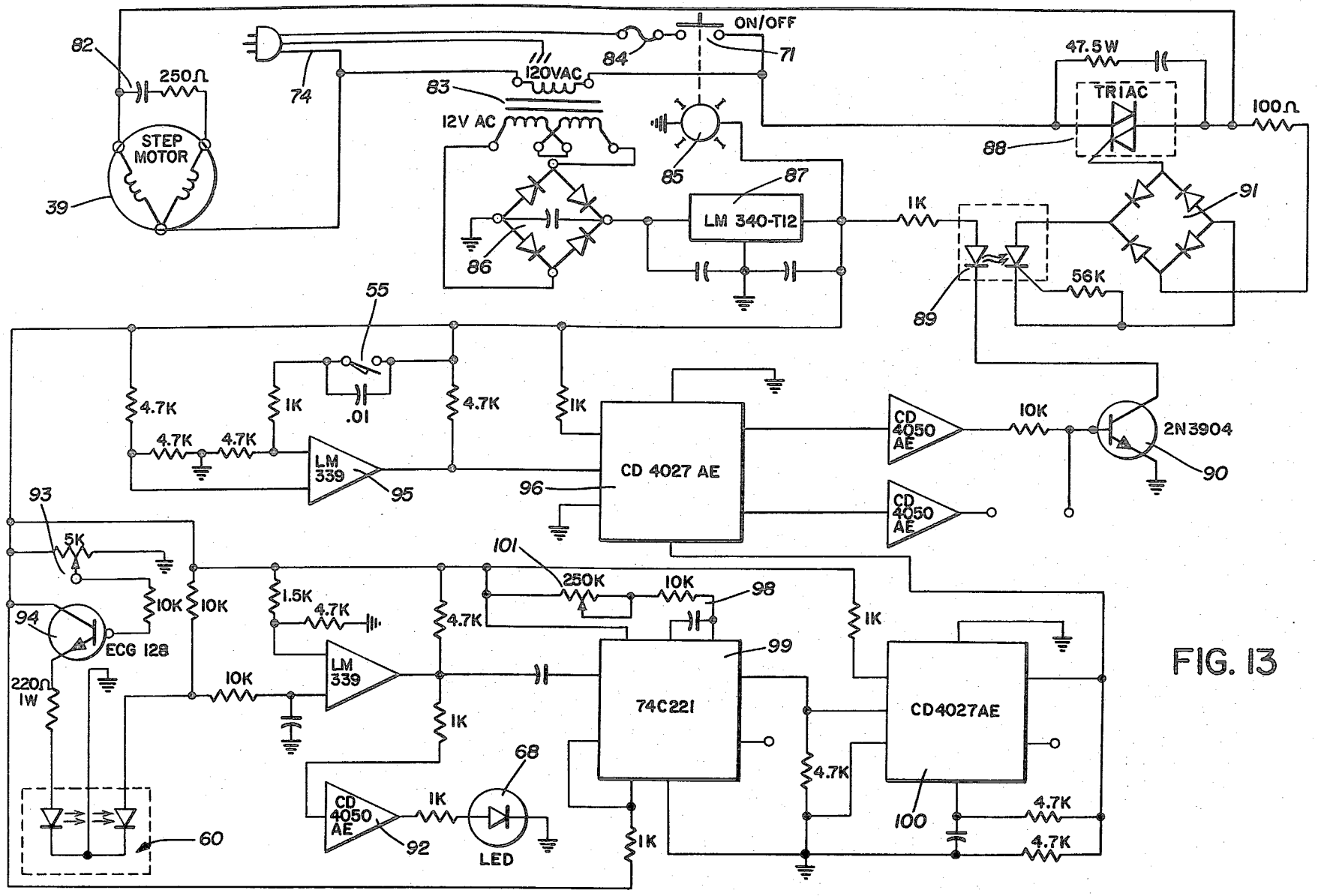
FIG. 13 is the electrical schematic wiring diagram of the control circuitry and detector assembly of the improved label dispensing machine.

The particular circuitry and the components shown in FIG. 13 illustrate the preferred circuit arrangement which enables the features of the improved label dispensing machine to be carried out. This circuitry may be modified and changed to provide the same results without affecting the concept of the invention. Stepping motor 39 is shown in the upper left-hand corner of FIG. 13 and includes an RC network 82 connected across the motor. The main power supply line 74 is connected to a 120 volt ac/12 volt ac transformer 83 with a fuse 84 being located in one leg of main power line 74. Fuse 84 is located within the removable fuse holder 75 discussed above. One leg of the main power supply ON-OFF switch 71 is in the same leg as fuse 84 and a power ON-OFF indicating light 85 is operatively connected with switch 71.

A full-wave bridge rectifier 86 is connected to the secondary of transformer 83 for converting the 12 volt ac secondary voltage to 12 volt dc. An IC 87 provides a voltage regulator for the output of bridge rectifier 86 to prevent the voltage from rising above a 12 volt maximum. A triac filtering circuit 88 turns the motor 39 on and off in response to signals received through a bridge rectifier 91 and an opto-isolator 89 which provides the interface between the low voltage of bridge 86 and the high voltage of rectifier 91. A transistor 90 provides the electrical switch for opto-isolator 89.

Photocell assembly 60 is shown schematically in the lower left-hand corner of FIG. 13. In accordance with one of the features of the invention, means are provided for adjusting the sensitivity of photocell 60. Light-emitting diode 68 is operatively connected with photocell 60 through an IC 92 and through appropriate amplifying circuitry, shown in the wiring diagram, to a sensitivity adjustment potentiometer 93. Potentiometer 93 is a variable resistor which is adjustable by inserting a screwdriver or other instrument through hole 69 in center plate 8. This adjustment affects the sensitivity of photocell 60 through transistor amplifier 94. Microswitch 55 is shown in the circuitry being connected with IC 95 and 96 and associated resistor networks for energizing motor 39 through the various motor control components discussed above.

In accordance with another of the main features of the invention, the electronic circuitry includes an adjustable timing circuit indicated generally at 98. Timing circuit 98 is formed principally of IC 99 and 100 and a variable resistor or potentiometer 101 which is controlled by label length adjustment knob 72. The various details and electrical component arrangements are not discussed in complete detail since the particular circuitry may be modified by anyone skilled in the art to provide the same features and advantages discussed above. The particular circuitry is set forth to show a preferred embodiment for carrying out the operation of improved label dispensing machine 1 and the various component nomenclature have been found to provide a satisfactory control system for achieving these results.

The main features and subassemblies of the electronic control circuitry are stepping motor 39, photocell 60, adjustment of the label detection sensitivity of photocell 60 by potentiometer 93, and the electronic timer 98 which is adjustable by variable resistor or potentiometer 101. It is these main components or subassemblies which are interconnected by the various circuitry shown in FIG. 13 which provides the desired features of label dispensing machine 1.

Upon loading a roll of labels 77 on supply reel 28, the sensitivity of photocell 60 is adjusted by potentiometer 93. A screwdriver or similar instrument is inserted through hole 69 and potentiometer 93 is adjusted until LED 68 is turned on. This indicates that the sensitivity of photocell 60 is at its most efficient level for the thickness or density of the particular carrier web 79 being used for the labeling operation being performed. This sensitivity control thus enhances the efficient operation of machine 1 in the detection of the label gaps for carrier webs of various materials. Another main advantage of machine 1 is the adjustability of timer circuit 98 through potentiometer 101 controlled by label length knob 92. Changing the effective resistance of potentiometer 101 regulates the time period of timing circuit 98 that maintains motor 39 energized which, correspondingly, regulates the amount of carrier web 79 which is advanced by drive roll 38.

Accordingly, the improved label dispensing machine provides a device which enables the partially dispensed position of the forward label to be regulated by adjusting the motor actuation time period, whereby labels of different lengths can be dispensed satisfactorily by the improved machine. Furthermore, the improved machine prevents uneven spacing between the adjacent labels from accumulating over a period of time resulting in improper positioning of the partially dispensed label. Also, the sensitivity of the gap detecting photocell is adjusted easily whereby label carrier webs of different densities can be compensated for to provide the most efficient operation of the improved label dispensing machine.

It is also recognized that dispensing machine 1 can be incorporated into a system whereby the labels can be dispensed automatically on a moving article without requiring the partially dispensed label to be manually removed from the discharge edge 22 of the machine, as shown in the drawings and described below. The moving article could easily trip lever arm 57 of microswitch 55 as it passes the discharge edge, energizing the drive motor to advance the next label for automatic application to a moving article on a conveyor or the like.

Accordingly, the improved label dispensing machine is simplified, provides an effective, safe, inexpensive and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved label dispensing machine is constructed and used, the characteristics of the construction, and the advantageous, new and useful results obtained, the new and useful structures, devices, elements, arrangements, parts, and combinations, are set forth in the appended claims.

I claim:

1. A machine for individually dispensing a label from a plurality of labels mounted in spaced relationship on a carrier web, said machine including:

(a) a slide plate;

(b) means for supporting a supply of labels and their carrier web;

(c) feed means for moving the web and labels across the slide plate;

(d) switch means for actuating the feed means upon removal of a label from the carrier web;

(e) electronic sensing means mounted adjacent the slide plate in the path of the moving web and labels for detecting the spacing between adjacent labels, said sensing means producing a signal upon detection of said label spacing;

(f) electronic timer means actuated by the signal from the sensing means for deactuating the feed means after passage of predetermined preset feed means actuated time period; and (g) adjustment means for regulating the preset feed means actuated time period of the timer means.

2. The label dispensing machine defined in claim 1 in which the adjustment means for the timer means is a potentiometer.

3. The label dispensing machine defined in claim 1 in which the feed means includes:

(a) a roll assembly adapted to be operatively engageable with the web for moving the web and labels across the slide plate;

and (b) an AC synchronous stepping motor for driving the roll assembly.

4. The label dispensing machine defined in claim 3 in which the roll assembly includes a drive roll operatively connected to and driven by the stepping motor, and a driven roll operatively engaged with and driven by the drive roll; in which the drive and driven rolls are mounted generally adjacent to and below a front label dispense end of the slide plate; and in which the web passes between said rolls and is moved thereby for moving the web and labels along the slide plate.

5. The label dispensing machine defined in claim 1 in which the slide plate has a back end and front label dispense end; in which the web and label support means is a rotatably mounted reel located adjacent the back end of the slide plate for holding a supply roll of the web and labels; and in which the switch means is located at the front end of the slide plate.

6. The label dispensing machine defined in claim 5 in which a guide shaft is mounted closely adjacent to and spaced above the slide plate and extends transversely across the path of the web for guiding the web as it is removed from the reel of the label support means.

7. The label dispensing machine defined in claim 5 in which the switch means is a microswitch having a trip lever; and in which the trip lever is moved to actuate the microswitch upon a label being removed from the web to actuate the feed means for the web and labels.

8. The label dispensing machine defined in claim 1 in which the electronic sensing means includes a photocell having an infrared emitter and receiver mounted on opposite sides of the path of the moving web and labels whereby an infrared beam from the emitter to the receiver will pass through the web to detect the spacing between adjacent labels due to the differences in density between the web and the web and label combination.

9. The label dispensing machine defined in claim 8 in which an opening is formed in the slide plate in the path of the web and labels; and in which the infrared emitter and receiver are located on opposite sides of the slide plate in registry with the slide plate opening.

10. The label dispensing machine defined in claim 8 including means for adjusting the sensitivity of the infrared photocell sensing means.

11. The label dispensing machine defined in claim 10 in which the adjusting means for the sensitivity of the infrared photocell sensing means is a potentiometer.

* * * * *